US011111764B2

(12) United States Patent
Molstre

(10) Patent No.: US 11,111,764 B2
(45) Date of Patent: Sep. 7, 2021

(54) WELLBORE ANNULAR SAFETY VALVE AND METHOD

(71) Applicant: SCHLUMBERGER TECHNOLOGY CORPORATION, Sugar Land, TX (US)

(72) Inventor: Oystein Molstre, Sandnes (NO)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/791,325

(22) Filed: Feb. 14, 2020

(65) Prior Publication Data

US 2020/0182026 A1 Jun. 11, 2020

Related U.S. Application Data

(62) Division of application No. 13/973,699, filed on Aug. 22, 2012, now Pat. No. 10,563,488.

(51) Int. Cl.

| | |
|---|---|
| ***E21B 33/126*** | (2006.01) |
| ***E21B 43/12*** | (2006.01) |
| ***E21B 34/10*** | (2006.01) |
| ***E21B 34/06*** | (2006.01) |

(52) U.S. Cl.

CPC ..... *E21B 43/12* (2013.01); *E21B 33/126* (2013.01); *E21B 34/06* (2013.01); *E21B 34/10* (2013.01); *E21B 43/122* (2013.01)

(58) Field of Classification Search

CPC .. E21B 33/126; E21B 43/122; E21B 33/1294; E21B 43/123

See application file for complete search history.

(56) References Cited

U.S. PATENT DOCUMENTS

| | | | | |
|---|---|---|---|---|
| 2,798,558 | A | 7/1957 | Mcculloch | |
| 2,896,547 | A | 7/1959 | Franey | |
| 3,659,961 | A * | 5/1972 | Lamb | E21B 43/122 417/114 |

(Continued)

FOREIGN PATENT DOCUMENTS

| | | | |
|---|---|---|---|
| GB | 2241722 | A | 9/1991 |
| WO | WO2001044619 | A1 | 6/2001 |
| WO | WO2013062566 | A1 | 5/2013 |

OTHER PUBLICATIONS

EP Application No. 1411745.2, Extended European Search Report, dated Nov. 27, 2015, 8 pgs.

*Primary Examiner* — Kipp C Wallace

(74) *Attorney, Agent, or Firm* — Kelly McKinney; Michael Dae

(57) ABSTRACT

A method includes deploying a tubing having a tubing bore in a casing in a wellbore, the tubing including a cup packer forming an annular barrier across a tubing-casing annulus separating the tubing-casing annulus into an upper annulus and a lower annulus, the cup packer having a fluid conduit extending substantially parallel to the tubing bore, and a barrier valve coupled with the fluid conduit to permit one-way fluid flow from the upper annulus to the lower annulus, communicating a fluid from the upper annulus through the barrier valve to the lower annulus, and closing the barrier valve in response to pressure in the upper annulus being less than pressure in the lower annulus.

8 Claims, 3 Drawing Sheets

(56) References Cited

U.S. PATENT DOCUMENTS

| | | | | |
|---|---|---|---|---|
| 3,746,089 | A * | 7/1973 | Vencil | E21B 43/122 166/106 |
| 4,398,555 | A | 8/1983 | Taylor | |
| 4,545,731 | A * | 10/1985 | Canalizo | F04F 1/08 417/111 |
| 4,589,482 | A | 5/1986 | Bayh, III | |
| 4,632,184 | A | 12/1986 | Renfroe, Jr. et al. | |
| 4,708,595 | A | 11/1987 | Maloney et al. | |
| 5,022,427 | A | 6/1991 | Churchman et al. | |
| 5,040,606 | A | 8/1991 | Hopper | |
| 5,875,852 | A | 3/1999 | Floyd et al. | |
| 6,745,844 | B2 | 6/2004 | Henderson | |
| 2004/0129433 | A1 | 7/2004 | Krawiec et al. | |
| 2009/0095467 | A1 | 4/2009 | Phoi-montri et al. | |
| 2010/0032153 | A1 | 2/2010 | Phloi-montri et al. | |
| 2010/0155077 | A1 | 6/2010 | Jardim De Azevedo et al. | |
| 2011/0132593 | A1 | 6/2011 | Phloi-montri et al. | |
| 2011/0303419 | A1 | 12/2011 | Maier | |
| 2012/0175108 | A1 | 7/2012 | Foubister et al. | |

* cited by examiner

WELLBORE ANNULAR SAFETY VALVE AND METHOD

CROSS-REFERENCE TO RELATED APPLICATION

This application is a divisional of U.S. Patent Application Publication No. 2015/0053416, filed Aug. 22, 2013, the disclosure of which is hereby incorporated by reference.

BACKGROUND

This section provides background information to facilitate a better understanding of the various aspects of the disclosure. It should be understood that the statements in this section of this document are to be read in this light, and not as admissions of prior art.

Hydrocarbon fluids such as oil and natural gas are obtained from a subterranean geological formation, referred to as a reservoir, by drilling a well that penetrates the hydrocarbon-bearing formation. Forms of well completion components may be installed in the wellbore to control and enhance efficiency of producing fluids from the reservoir.

SUMMARY

A well system in accordance to one or more embodiments includes an annular barrier disposed in a tubing-casing annulus of a wellbore separating the tubing-casing annulus into an upper annulus and a lower annulus and a barrier valve coupled with the annular barrier, the barrier valve permitting one-way fluid communication from the upper annulus to the lower annulus. An annular safety valve in accordance with an embodiment includes dual cup packers oriented in opposite direction disposed about a mandrel having a tubing bore, a fluid conduit extending through the dual cup packers substantially parallel to the tubing bore, and a barrier valve in connection with the fluid conduit to permit one-way fluid flow through the fluid conduit. A method includes deploying tubing having a tubing bore in casing in a wellbore, the tubing having a cup packer forming an annular barrier across a tubing-casing annulus, the cup packer having a fluid conduit extending substantially parallel to the tubing bore, and a barrier valve coupled with the fluid conduit to permit one-way fluid flow from the upper annulus to the lower annulus, communicating a fluid from the upper annulus through the barrier valve to the lower annulus, and closing the barrier valve in response to pressure in the upper annulus being less than pressure in the lower annulus.

The foregoing has outlined some of the features and technical advantages in order that the detailed description of the annular safety valves, systems, and methods that follow may be better understood. Additional features and advantages of the annular safety valve system and method will be described hereinafter which form the subject of the claims of the invention. This summary is not intended to identify key or essential features of the claimed subject matter, nor is it intended to be used as an aid in limiting the scope of claimed subject matter.

BRIEF DESCRIPTION OF THE DRAWINGS

Embodiments of annular safety valves and methods are described with reference to the following figures. The same numbers are used throughout the figures to reference like features and components. It is emphasized that, in accordance with standard practice in the industry, various features are not necessarily drawn to scale. In fact, the dimensions of various features may be arbitrarily increased or reduced for clarity of discussion.

DETAILED DESCRIPTION

Figure 1:
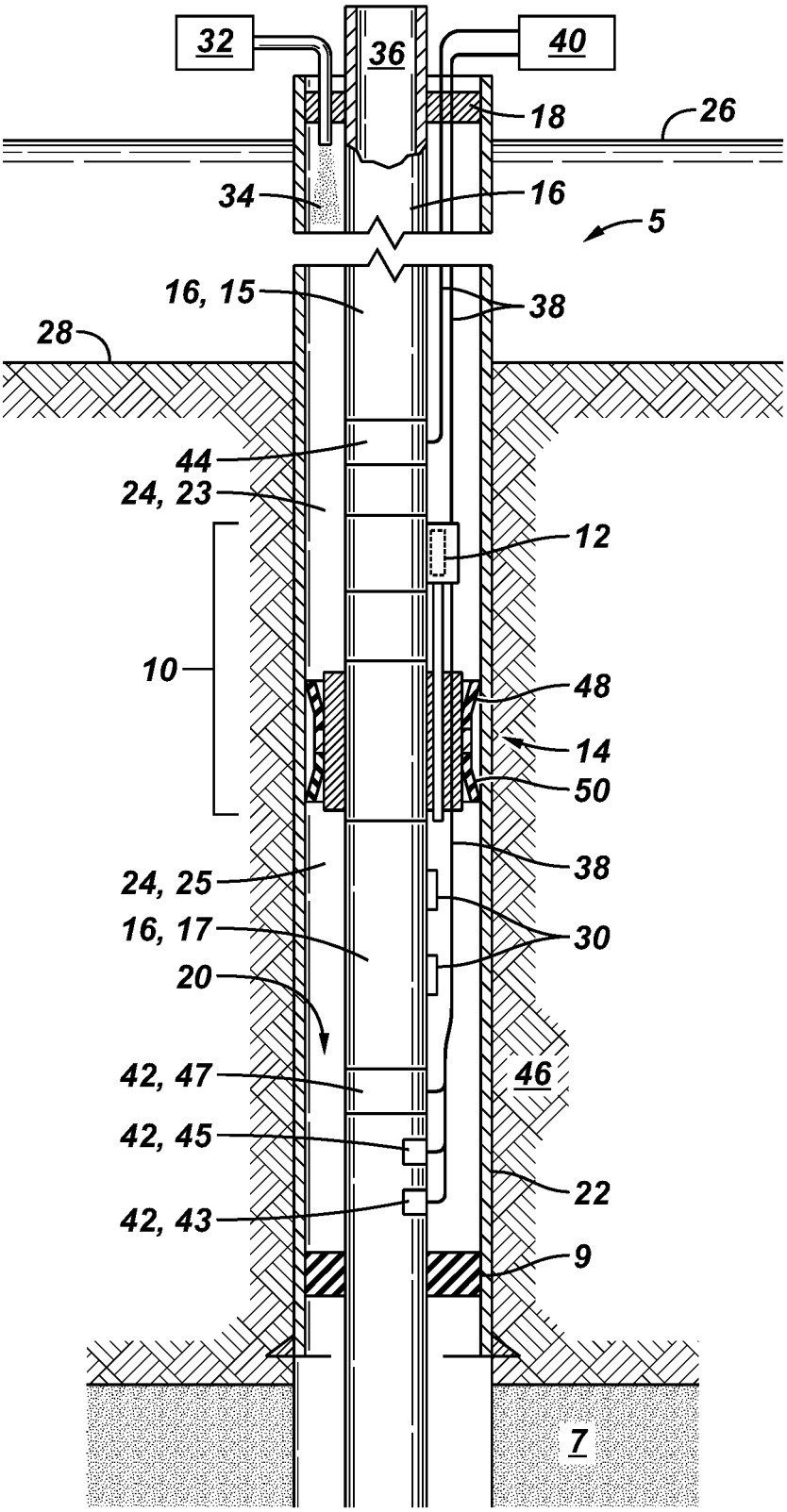
FIG. 1 illustrates a well system in which an annular safety valve in accordance to one or more embodiments is incorporated.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "upper" and "lower," "top" and "bottom," and other like terms indicating relative positions to a given point or element are utilized to more clearly describe some elements. Commonly, these terms relate to a reference point as the surface from which drilling operations are initiated as being the top point and the total depth being the lowest point, wherein the well (e.g., wellbore, borehole) is vertical, horizontal or slanted relative to the surface.

Generally, a well consists of a wellbore drilled through one or more reservoir production zones. Conductor casing serves as support during drilling operations and provides support for a wellhead and Christmas tree. In offshore wells, a riser may extend the wellbore from the sea floor to the surface platform. One or more strings of casing with diminishing inside diameters will be run inside of the conductor. The well may then be completed with a tubing string extending to the one or more reservoir production zones. The annulus between the tubing and the smallest diameter casing, i.e., the A-annulus, extends from the producing zones to the surface. The surface barrier seals the tubing-casing annulus from the environment. The tubing may be landed for example in a production packer located above the upper most production zone to isolate the annulus from the producing zones. The tubing-casing annulus may extend thousands of feet from the surface to the production packer.

The tubing-casing annulus may be utilized for example for gas-injection into the tubing to reduce the density of the fluid in the tubing to facilitate production to the surface. The tubing-casing annulus may be exposed to the surrounding formations via perforations or loss of casing integrity. In the case of failure of the surface annular barrier, for example located at the wellhead, wellbore fluid in the tubing-casing annulus will be in communication with the environment.

In accordance to one or more embodiments, an annular safety valve is integrated in the tubing to provide an annular safety barrier in the upper completion. In accordance with embodiments, the annular safety valve provides one-way fluid flow from the upper annulus to the lower annulus. In accordance to one or more embodiments, the annular safety valve provides one or more control line bypasses to operationally connect devices in the lower completion below the annular safety valve to surface control systems at the surface or in the upper completion above the annular safety valve. In accordance to one or more embodiments, the annular safety valve is not surface controlled.

FIG. 1 illustrates a well system 5 in which a subsurface annular safety valve ("ASV"), generally denoted by the numeral 10, may be incorporated and utilized. Annular safety valve 10 includes a one-way barrier valve 12 coupled with an annular barrier 14. In accordance with embodiments, annular barrier 14 is packer, for example a dual cup packer. Annular barrier 14 provides a sealed annular barrier between the tubing and casing. Barrier valve 12 is illustrated as being located above annular barrier 14 in FIG. 1, however, as will be understood by those skilled in the art with benefit of this disclosure, barrier valve 12 may be locate below annular barrier 14. Barrier valve 12 provides one-way fluid flow in the direction from the upper completion or upper annulus across annular barrier 14 to the lower completion or lower annulus. In accordance to one or more embodiments, barrier valve 12 is normally closed, fail safe close, and actuated to the open position in response to pressure in the upper annulus being greater than pressure in the lower annulus. Similarly, barrier valve 12 is actuated to the closed position in response to pressure in the lower annulus exceeding pressure in the upper annulus.

Well system 5 is illustrated as a gas lift completion that includes tubing 16 that extends from an upper or surface barrier 18 into a wellbore 20. A portion of wellbore 20 is completed with casing 22. The tubing-casing annulus, generally denoted by the numeral 24, between tubing 16 and casing 22 may be referred to as the A-annulus. Surface barrier 18, for example a tubing hanger, is depicted in FIG. 1 located at a water surface 26, for example at a platform, e.g., tension leg platform, or ship, positioned above a sea floor 28. Surface barrier 18 may be located in the wellhead area. Reference to the surface of the well is not limited to the sea surface or sea floor. Annular safety valve 10 is set in the upper completion and separates tubing-casing annulus 24 into an upper annulus 23 and a lower annulus 25. Tubing 16 may be landed at a production packer 9 located isolating lower annulus 25 from a production zone 7, i.e., reservoir formation. Production packer 9 may be utilized to anchor tubing 16 and annular safety valve 10 with casing 22.

Tubing 16 incorporates one or more gas lift valves 30 which are located in the lower tubing section 17 below annular safety valve 10 in wellbore 20. For purposes of gas injection, well system 5 includes a gas compressor 32 located at the surface to pressurize gas that is communicated to tubing-casing annulus 24. The pressurized gas 34 is communicated from upper annulus 23 through annular safety valve 10 to lower annulus 25. The pressurized gas 34 is communicated from lower annulus 25 into tubing bore 36 through gas lift valves 30.

One or more control lines 38 may extend from a surface system 40, for example an electronic controller and or pressurized fluid source, to downhole devices, generally denoted by the numeral 42, located below annular safety valve 10. Downhole devices 42 may include devices such as, and without limitation to, pressure, temperature, and flow rate sensors 43, chemical injection valves 45, and flow control valves 47. In accordance to one or more embodiments, annular safety valve 10 provides control line bypasses from the upper completion or surface to the lower completion while maintaining an annular barrier.

Together, annular safety valve 10 and tubing 16 can serve as a primary barrier to maintain well integrity. In the depicted embodiment, a downhole safety valve 44 is located in the upper section 15 of tubing 16, for example proximate to annular barrier 14, to provide a vertical barrier through tubing bore 36. In this example, downhole safety valve 44 is a surface controlled subsurface safety valve ("SCSSV") connected to the surface via a control line 38. Subsurface safety valve 44 may be a wireline or tubing set type. Annular safety valve 10 serves as a safety barrier in A-annulus 24 in the event that surface barrier 18 is lost. Lower annulus 25 although located above production packer 9 in FIG. 1, may be in communication with formation fluids and pressure. For example, perforations or loss integrity of casing 22 may expose tubing-casing annulus 24 to the surrounding formation 46. In FIG. 1, gas lift injection through lower annulus 25 may temporarily supercharge formation 46.

Figure 2:
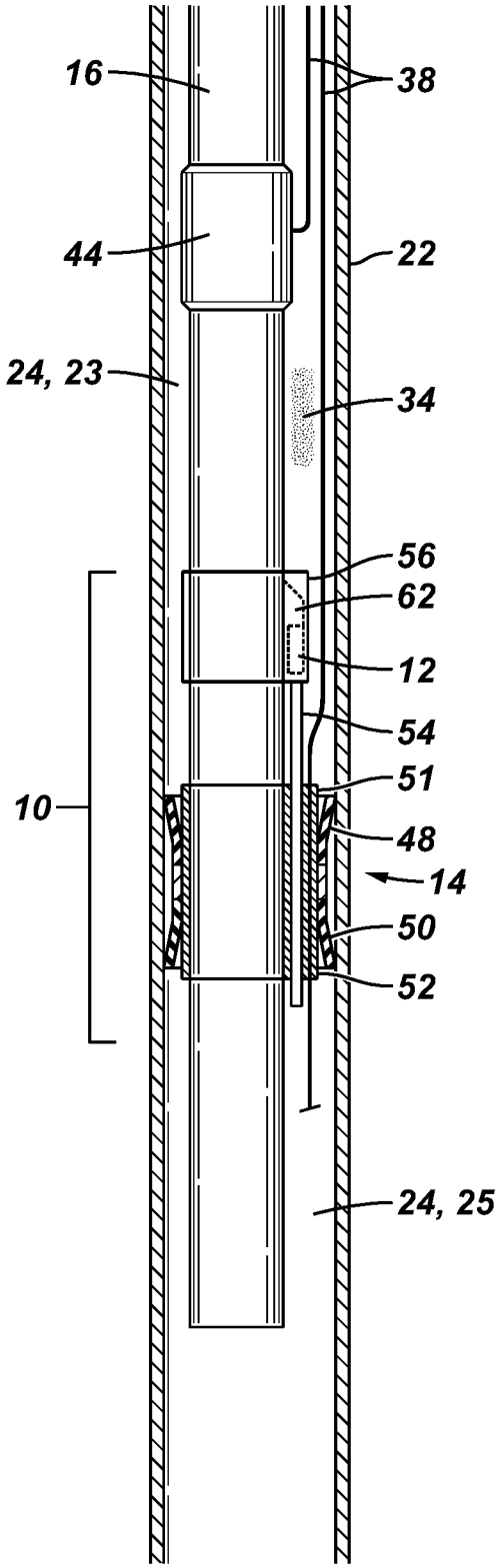
FIG. 2 illustrates an annular safety valve in accordance to one or more embodiments.
Figure 3:
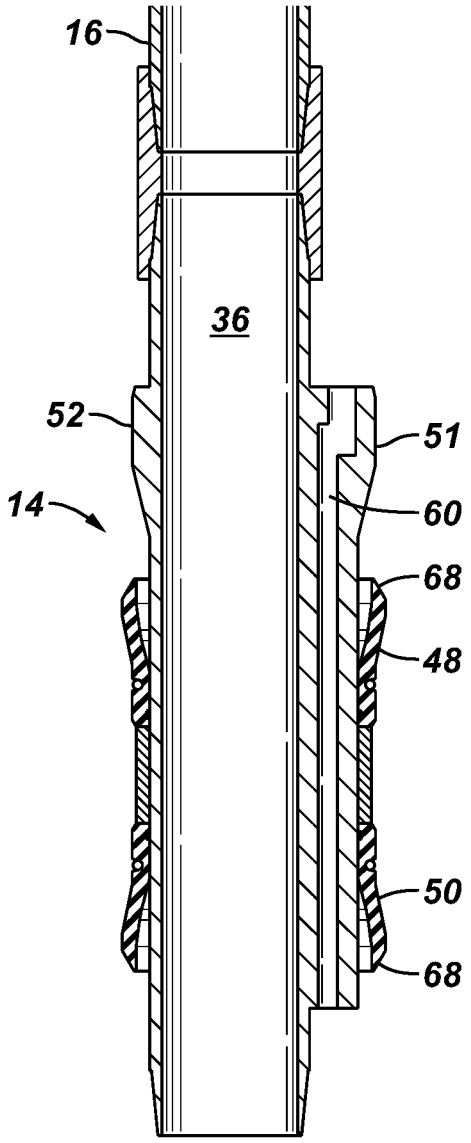
FIG. 3 illustrates an annular barrier in accordance to one or more embodiments.
Figure 4:
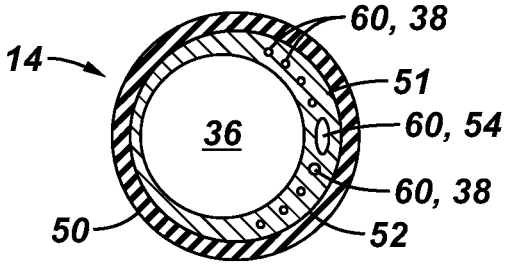
FIG. 4 is a bottom view illustration of an annular barrier in accordance to one or more embodiments.
Figure 5:
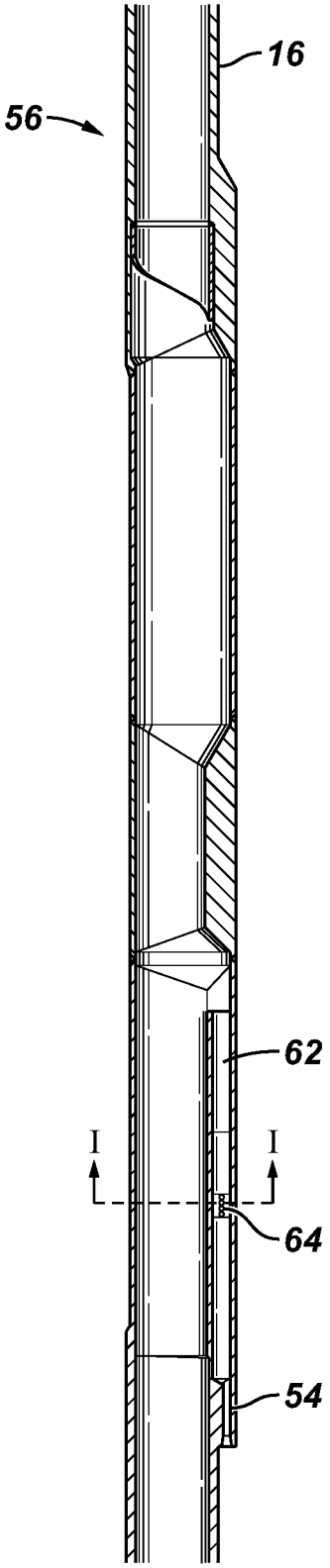
FIG. 5 illustrates a side pocket mandrel in accordance to one or more embodiments.
Figure 6:
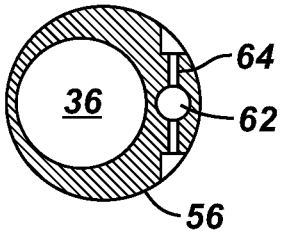
FIG. 6 illustrates a side pocket mandrel along the line I-I of FIG. 5.

FIG. 2 illustrates a retrievable annular safety valve 10 integrated in tubing 16 and deployed in casing 22. FIG. 3 illustrates annular barrier 14 in isolation and FIG. 4 illustrates a bottom end view of an annular barrier 14. Annular barrier 14 is illustrated as a dual cup packer having a top cup packer 48 or downstream cup packer and a bottom cup packer 50 or upstream cup packer. Top packer 48 has an open end 68 oriented toward upper annulus 23 and bottom packer 50 has an open end 68 oriented toward lower annulus 25. Pressure in upper annulus 23 expands top cup packer 48 against casing 22 and pressure in lower annulus 25 expands bottom cup packer 50 against casing 22.

Cup packers 48, 50 are disposed about a feed-through mandrel 52 having a thick side 51. Bypass ports, generally denoted by the reference number 60, are formed longitudinally through thick side 51 of annular barrier 14, for example substantially parallel to tubing bore 36, to pass or form a portion of an annular fluid conduit 54. Barrier valve 12 is coupled with fluid conduit 54 to provide one-way upper annulus 23 to lower annulus 25 fluid flow. In FIG. 2, barrier valve 12 is located in a side pocket mandrel 56 integrated, i.e., connected, with tubing 16. Annular safety valve 10 is illustrated in FIG. 2 eccentrically disposed in casing 22 with side pocket 62 aligned longitudinally with thick side 51 of annular barrier 14.

One or more additional bypass ports 60 are formed through annular barrier 14, for example feed-through mandrel 52, to pass control lines 38. The annular barrier 14 depicted in FIG. 4 forms eight bypasses 60 communicating control lines 38. Control lines 38 include without limitation, electrical, optic, and hydraulic lines.

With reference in particular to FIGS. 1-2 and 5-6, barrier valve 12 is a one-way valve providing fluid connection across annular barrier 14 from upper annulus 23 to lower annulus 25 through passage or conduit 54. Although barrier valve 12 is illustrated located above annular barrier 14 in FIGS. 1 and 2, it will be understood by those skilled in the art with benefit of this disclosure that barrier valve 12 can be located below annular barrier 14 to provide fluid communication in the direction from upper annulus 23 to lower annulus 25.

In accordance to one or more embodiments, barrier valve 12 is located in a side pocket mandrel 56. Barrier valve 12 is disposed in pocket 62 to provide one-way annulus to annulus fluid communication. Fluid, such as gas 34, flows from upper annulus 23 through port(s) 64 into pocket 62 and through barrier valve 12 into conduit 54 and lower annulus 25. Side pocket mandrel 56 may not include a port between tubing-casing annulus 24 and tubing bore 36 or the tubing bore may not be in communication with tubing-casing annulus 24 through barrier valve 12. Side pocket mandrel 56 may be a single or a dual pocket mandrel.

Figure 7:
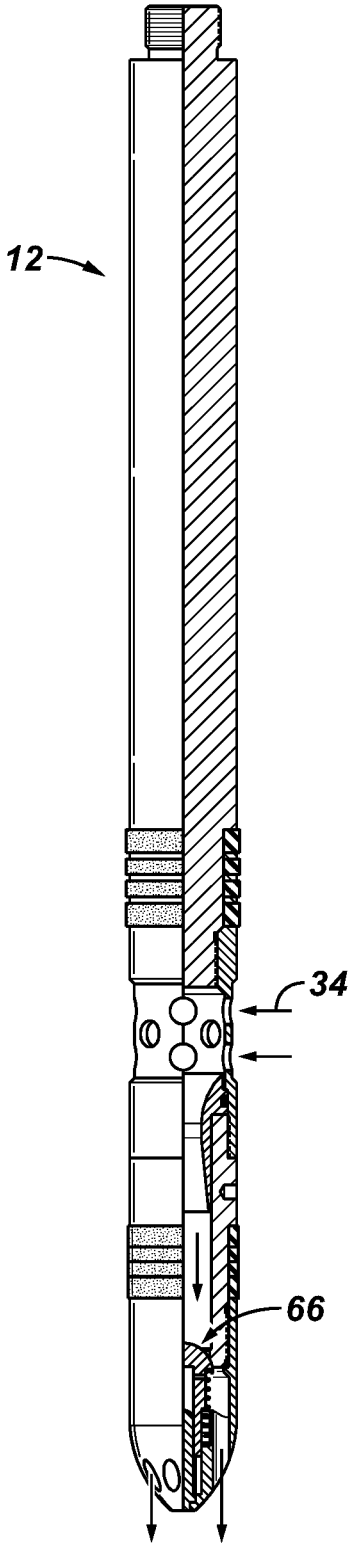
FIG. 7 illustrates a barrier valve in accordance to one or more embodiments.

FIG. 7 illustrates a gas lift type barrier valve 12 in accordance to one or more embodiments. Barrier valve 12 includes a reverse flow check valve 66 suited for barrier applications. For example, barrier valve 12 is a barrier-qualified, reverse flow check valve that provides positive seal between the lower annulus side and the upper annulus side. In accordance to one or more embodiments, barrier valve 12 has metal-to-meal seal surfaces without elastomers. Some embodiments may have elastomer seal surfaces. A non-limiting example of barrier valve 12 is a NOVA 15-B type of gas lift valve available from Schlumberger.

In accordance to one or more embodiments, a surface control system is not required for operation of annular safety valve 10. Barrier valve 12 may be retrieved, for example via wireline or slickline, eliminating the need to retrieve the completion, e.g., tubing, to maintain the well integrity. If the pressure in lower annulus 25 exceeds the pressure in upper annulus 23, barrier valve 12 closes. Accordingly, barrier valve 12 fails safe closed if the surface barrier is lost. Annular safety valve 10 is insensitive to setting depth. In accordance with one or more embodiments, barrier valve 12 may be eliminated for example by eliminating or plugging conduit 54. For example, a dummy valve may be landed in pocket 62 to plug conduit 54.

A method in accordance to one or more embodiments is now described with reference to FIGS. 1-7. When running the completion, tubing 16 is made-up at the surface to include annular safety valve 10 located above gas-lift valves 30. Side-pocket mandrel 56 and annular barrier 14 are aligned such that side pocket 62 and thick side 51 are aligned longitudinally. Fluid conduit 54 is connected with or passed through a bypass port 60 of annular barrier 14. Control lines 38 are connected with or passed through bypass ports 60. Annular safety valve 10 is run into the wellbore and pressure in tubing-casing annulus 24 acts to seal cup packers 48, 50 with casing 22 separating tubing-casing annulus 24 into an upper annulus 23 and a lower annulus 25. Fluid, for example gas 34, is communicated from upper annulus 23 through barrier valve 12 and across annular barrier 14 in response to pressure in the upper annulus being greater than pressure in lower annulus 25. Gas 34 is injected from lower annulus 25 through gas lift valves 30 into tubing bore 36. Barrier valve closes in response to the pressure in upper annulus 23 being less than the pressure in lower annulus 25.

The foregoing outlines features of several embodiments of annular safety valves, systems, and methods so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A method, comprising:

deploying a tubing having a tubing bore in a casing in a wellbore, the tubing comprising a cup packer forming an annular barrier across a tubing-casing annulus separating the tubing-casing annulus into an upper annulus and a lower annulus, the cup packer having a fluid conduit extending substantially parallel to the tubing bore, and a barrier valve coupled with the fluid conduit to permit one-way fluid flow from the upper annulus to the lower annulus;

communicating a fluid from the upper annulus through the barrier valve to the lower annulus; and closing the barrier valve in response to pressure in the upper annulus being less than pressure in the lower annulus, wherein the barrier valve is located in a side pocket of a side pocket mandrel integrated in the tubing, wherein the cup packer is disposed about a feed-through mandrel having a first side and a second side, the first side being thicker than the second side, and wherein the side pocket mandrel and the annular barrier are aligned such that the side pocket and the first side of the feed-through mandrel are aligned longitudinally.

2. The method of claim 1, wherein the fluid is a pressurized gas and further comprising injecting the pressurized gas from the lower annulus through a gas lift valve into the tubing bore.

3. The method of claim 1, further comprising a control line extending from the upper annulus through the annular barrier to the lower annulus.

4. The method of claim 1, wherein the barrier valve is normally closed and the barrier valve is opened in response to pressure in the upper annulus being greater than pressure in the lower annulus.

5. The method of claim 3, wherein:

the barrier valve is located in a side pocket mandrel integrated in the tubing;

the fluid is a pressurized gas; and further comprising injecting the pressurized gas from the lower annulus through a gas lift valve into the tubing bore.

6. The method of claim 1, wherein the feed-through mandrel comprises a port to pass a control line across the annular barrier of the cup packer.

7. The method of claim 1, wherein the cup packer is a dual cup packer.

8. The method of claim 1, wherein the barrier valve is located above the annular barrier.

* * * * *